US007850063B1

(12) United States Patent
Boone

(10) Patent No.: US 7,850,063 B1
(45) Date of Patent: Dec. 14, 2010

(54) PERMANENT SEAL LEGAL ENVELOPE

(75) Inventor: Cheynetta L. Boone, 1096 Cascade Blvd., Chesapeake, VA (US) 23324

(73) Assignee: Cheynetta L. Boone, Chesapeake, VA (US)

( * ) Notice: Subject to any disclaimer, the term of this patent is extended or adjusted under 35 U.S.C. 154(b) by 254 days.

(21) Appl. No.: 11/648,775

(22) Filed: Nov. 14, 2006

(51) Int. Cl.
*B65D 27/30* (2006.01)
*B65D 27/14* (2006.01)

(52) U.S. Cl. ..... 229/83; 206/807; 229/80; 428/34.3; 428/916

(58) Field of Classification Search ..... 229/102, 229/80, 83; 206/807; 428/34.3, 67, 916
See application file for complete search history.

(56) References Cited

U.S. PATENT DOCUMENTS 4,838,708 A * 6/1989 Holcomb et al. ..... 229/102
5,060,848 A * 10/1991 Ewan ..... 229/102
5,082,702 A * 1/1992 Alband ..... 428/916
5,294,470 A * 3/1994 Ewan ..... 229/102
5,582,887 A * 12/1996 Etheredge ..... 206/807
6,471,058 B2 * 10/2002 Kannabiran et al. ..... 206/459.1
2005/0145683 A1 * 7/2005 Alagna et al. ..... 229/102

FOREIGN PATENT DOCUMENTS

GB 2280402 A * 2/1995

* cited by examiner

*Primary Examiner*—Gary E Elkins

(57) ABSTRACT

A tamper evident envelope is disclosed which includes sealing strips located within the seams of the envelope. Each strip is formed by two clear plastic strips secured together. One of the clear plastic strips includes a groove and a dye located within the groove whereby the dye is sealed between the two clear plastic strips. When a seam is separated, the sealing strip is damaged thereby releasing the dye onto the adjacent portions of the envelope and providing visual evidence that the seam was opened. A second embodiment is disclosed where the dye is omitted and separation of the secured clear plastic strips results in damage to the envelope providing visual evidence of tampering.

6 Claims, 18 Drawing Sheets

PERMANENT SEAL LEGAL ENVELOPE

FIELD OF THE INVENTION

The present invention relates generally to envelopes incorporating a tamper evident security seal which indicates opening of the envelope along the seams.

BRIEF DESCRIPTION OF THE DRAWINGS

FIG. 7 illustrates two clear plastic strips which together form a laminated strip with a dye being placed there between.

DETAILED DESCRIPTION OF THE DRAWINGS

The present invention will now be described with reference to the accompanying drawings. The present invention is directed to an envelope formed by front and back walls connected at sides 5 of each wall. The back wall includes an upper extension or fold 3 and a lower extension or fold 4 which form top and bottom seams respectively, when folded and secured to the front wall at top and bottom portions thereof.

Figure 7:
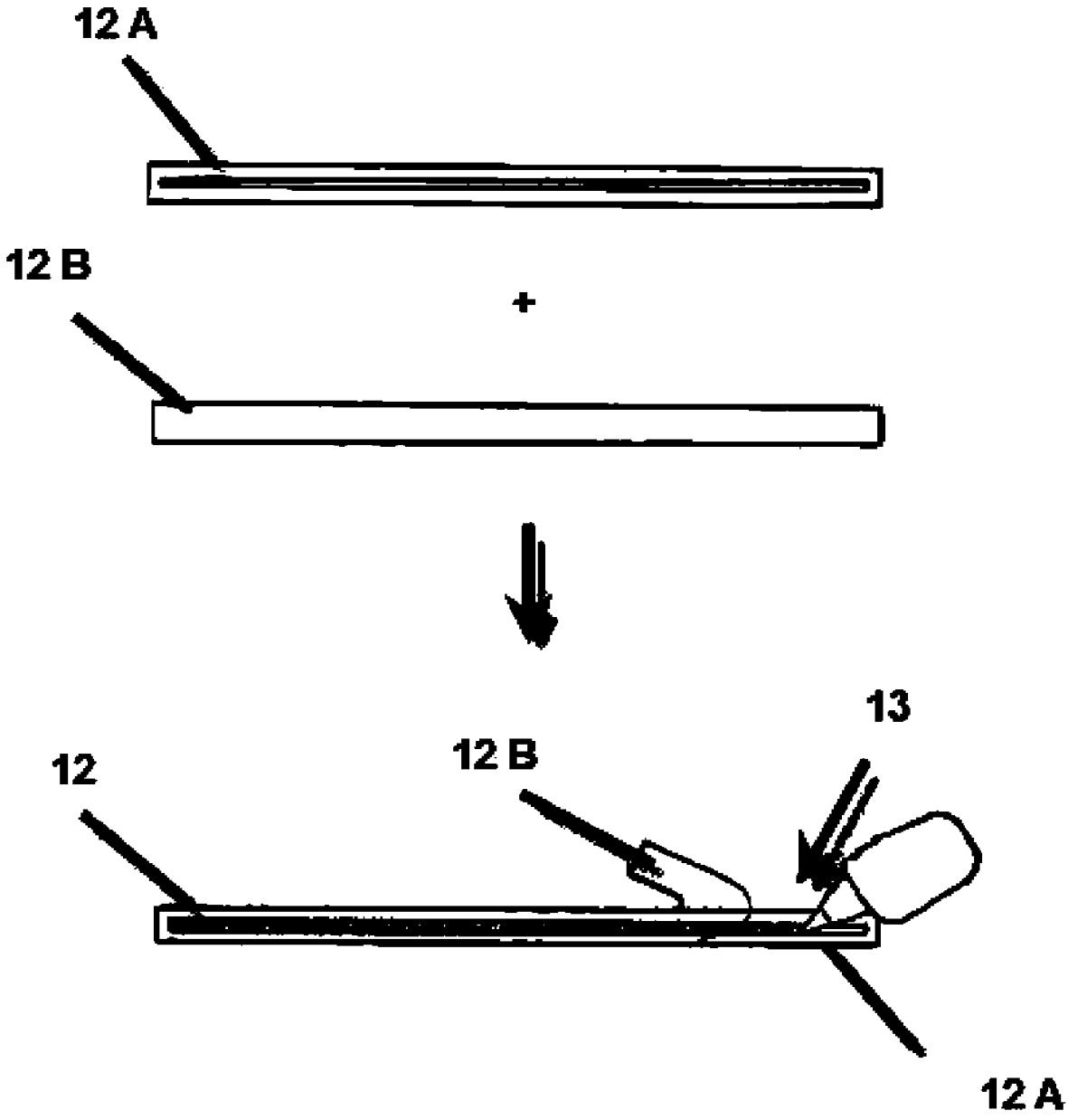
Figure 8:
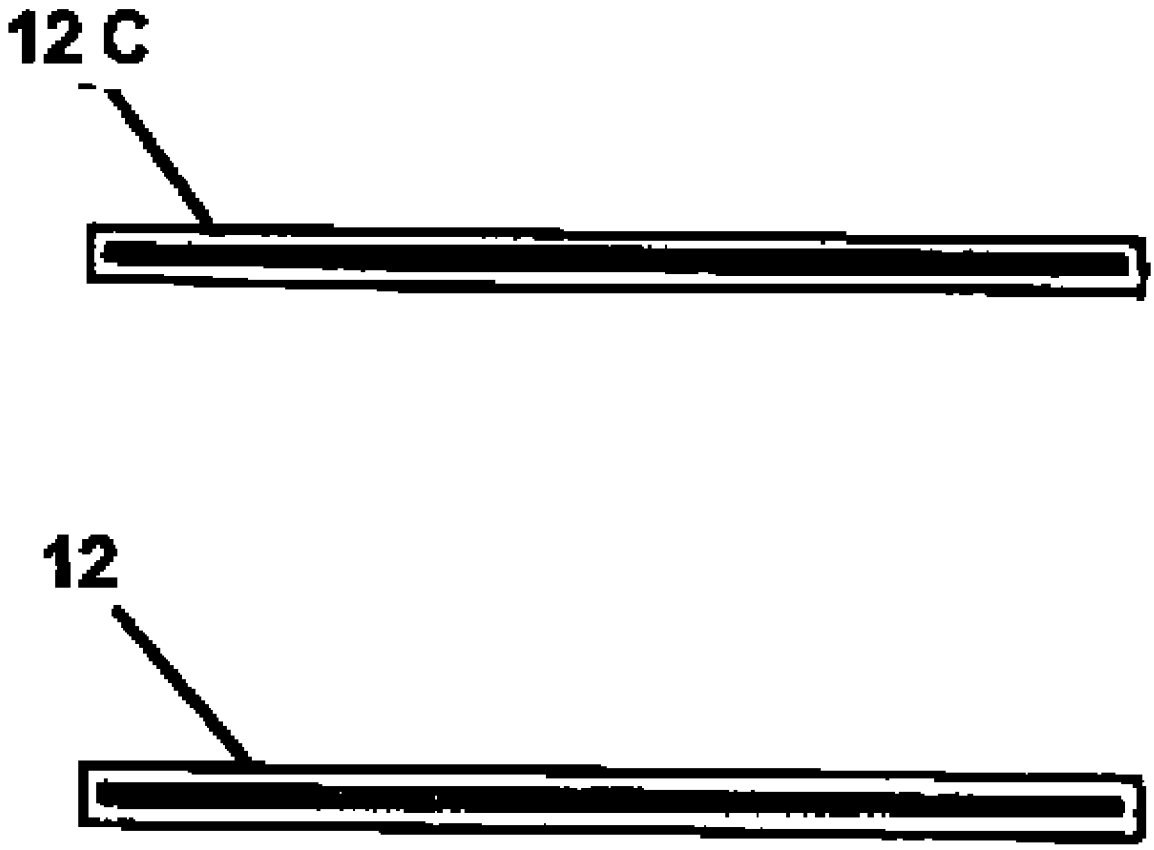
FIG. 8 illustrates the front and back of the dye clear plastic strip.
Figure 12:
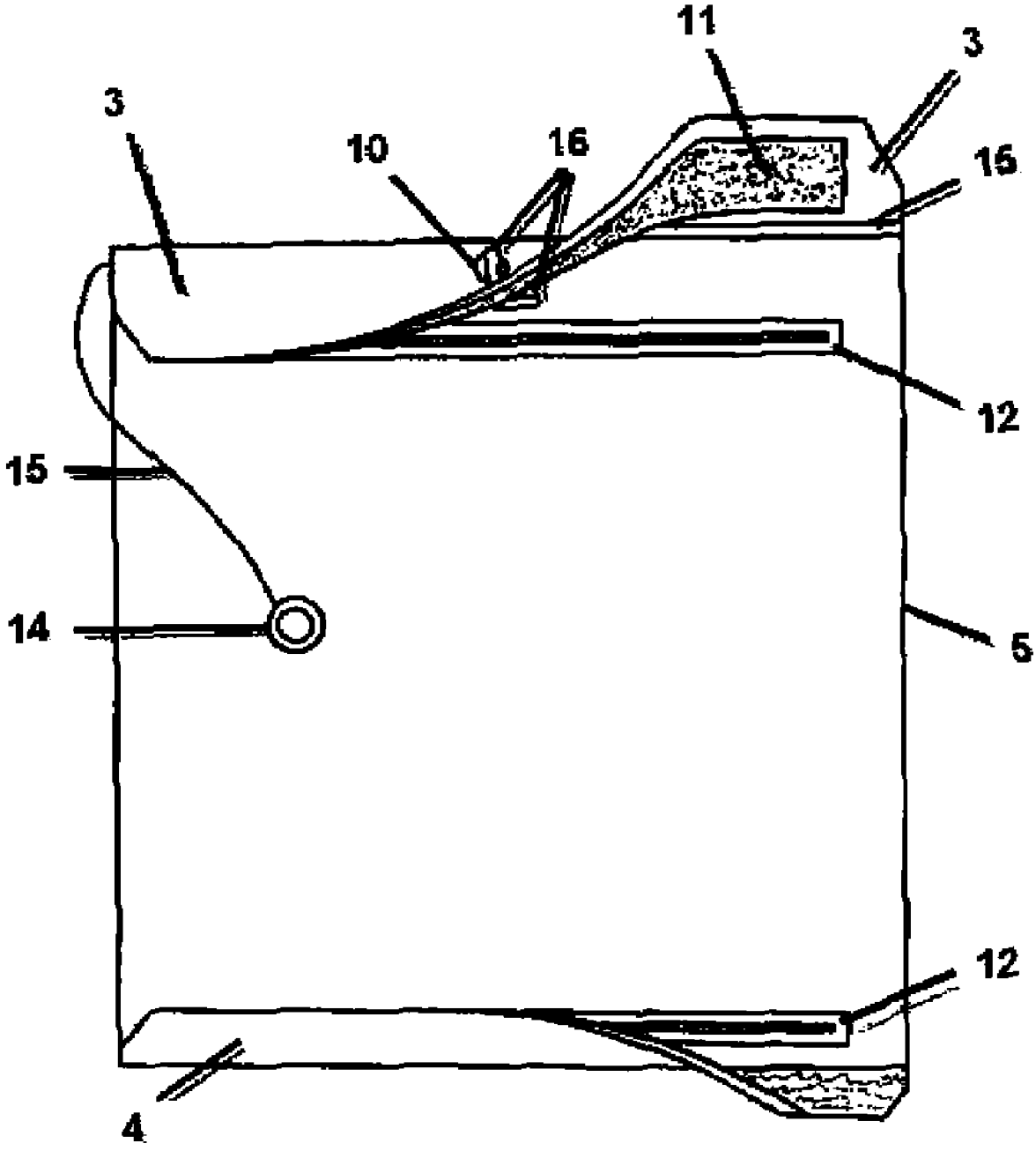
FIG. 12 shows the permanent seal legal envelope with the top and bottom folds in a partially folded position.

The bottom seam of the envelope is formed by securing fold 4 to the front wall via a strip 12. As depicted in FIG. 7, the strip 12 comprises a first clear strip 12A which incorporates a groove along the length thereof. The groove is filled with a dye 13 and a second clear strip 12B is secured to the first clear strip 12A to seal the dye within the groove. As depicted in FIG. 12, the strip 12 is glued to the front wall of the envelope and the fold 4 is glued to the strip 12 using plastic adhesive glue 17. The back of the strip 12 is shown at 12C in FIG. 8.

Figure 1:
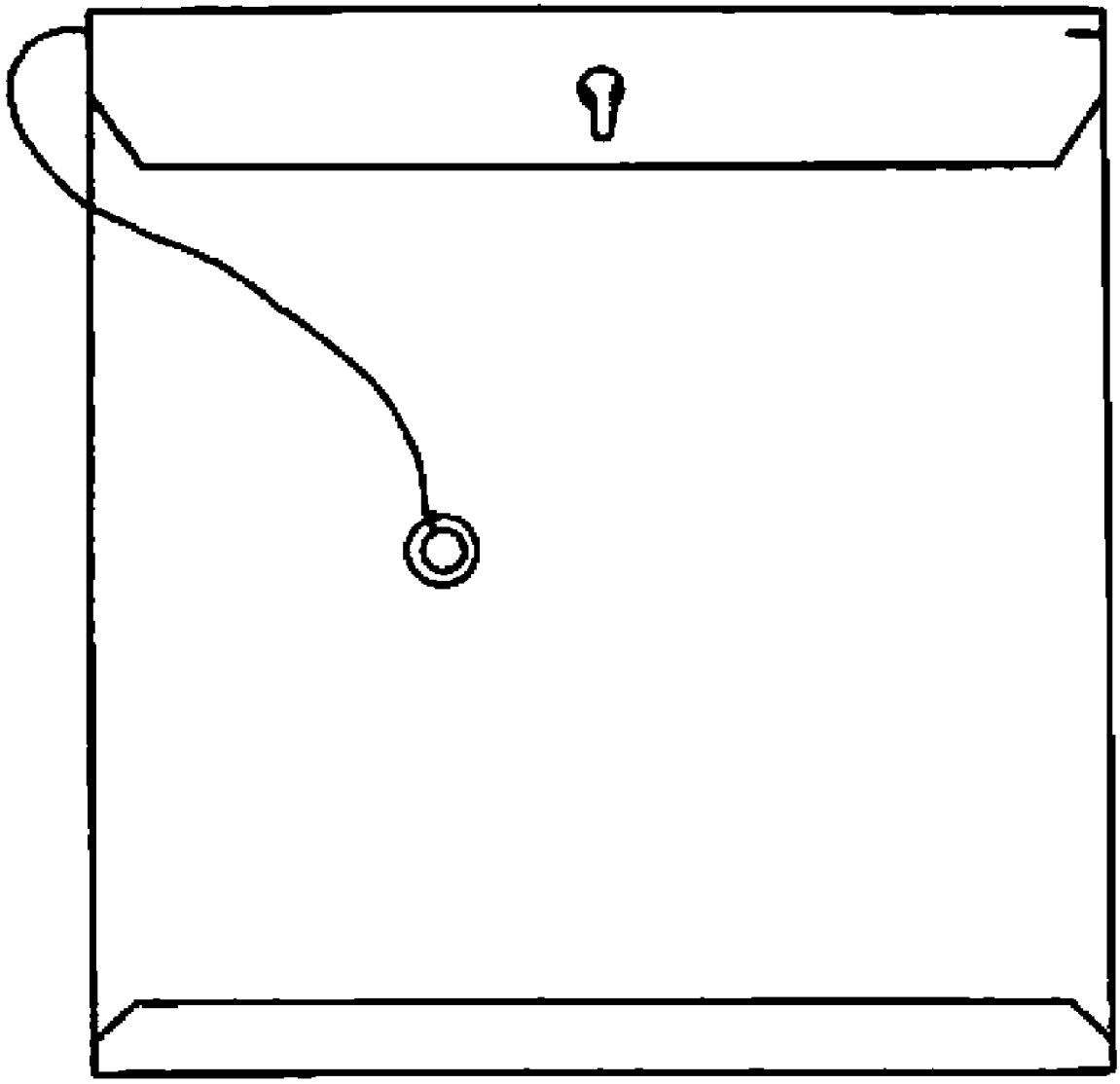
FIG. 1 is a plan view of the front of the envelope in a closed position.
Figure 2:
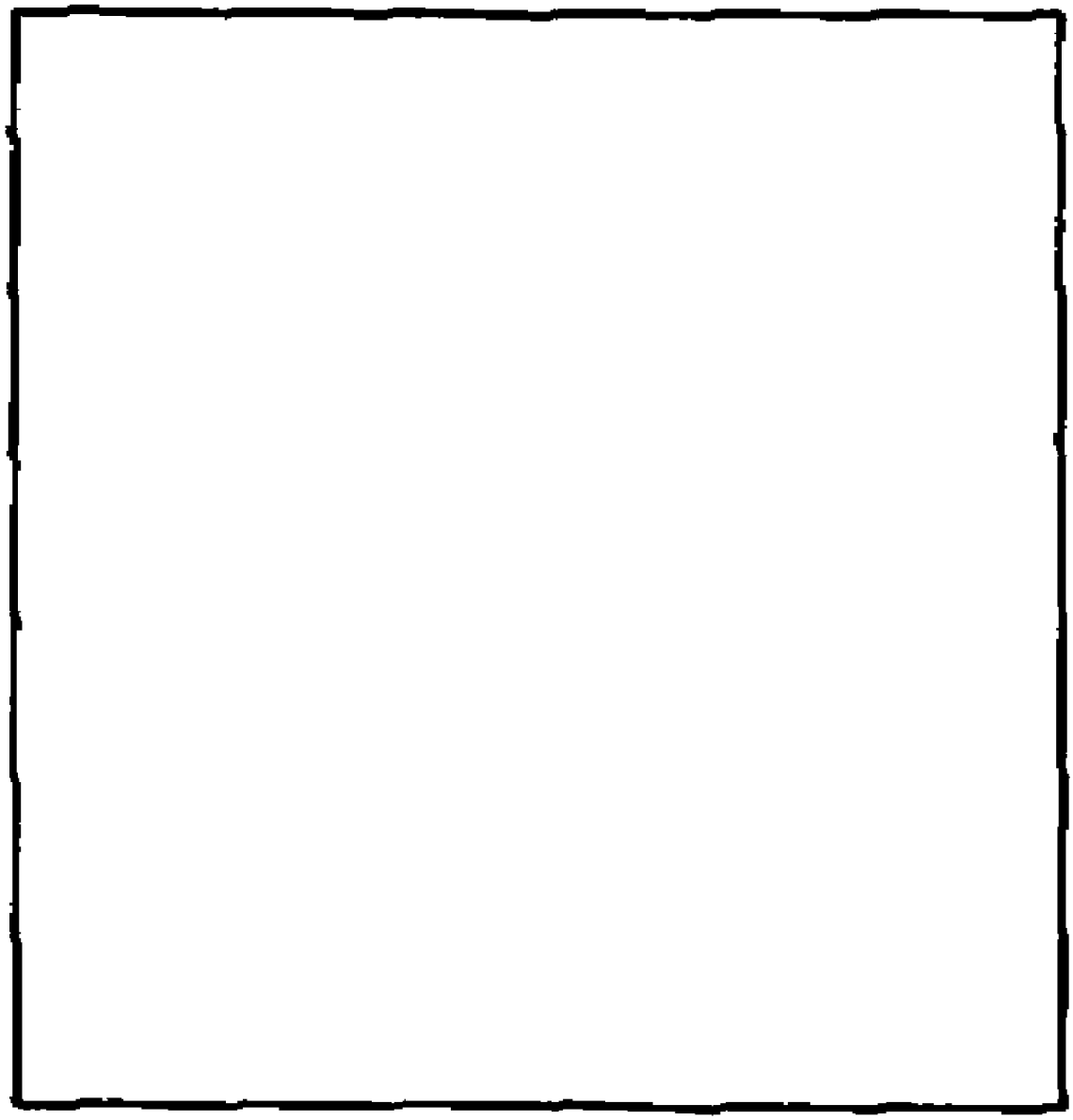
FIG. 2 is a plan view of the back of the envelope in a closed position.
Figure 3:
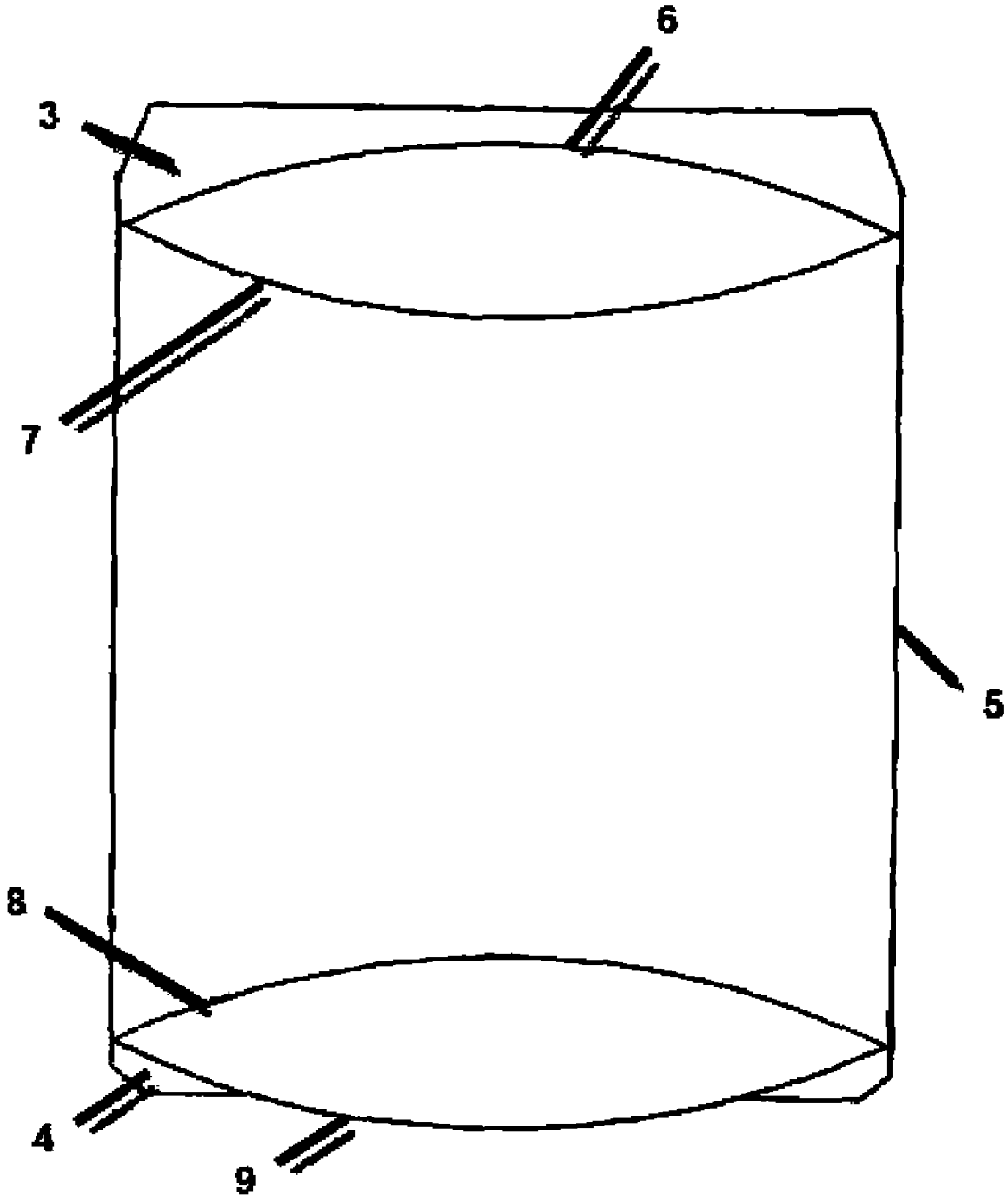
FIG. 3 is a perspective view of the envelope with upper and lower rims.
Figure 4:
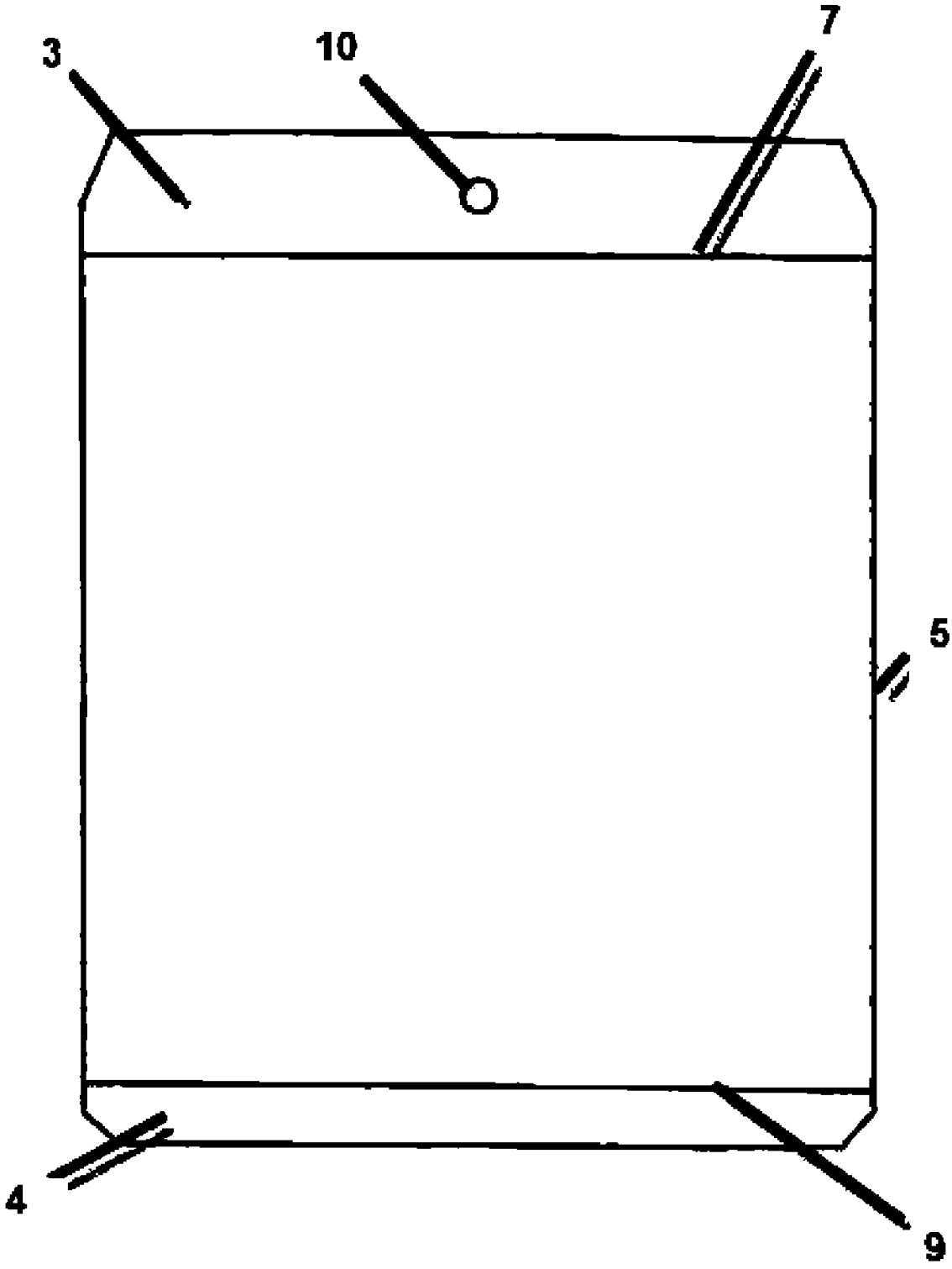
FIG. 4 is a plan view of the envelope with open top and bottom folds.
Figure 5:
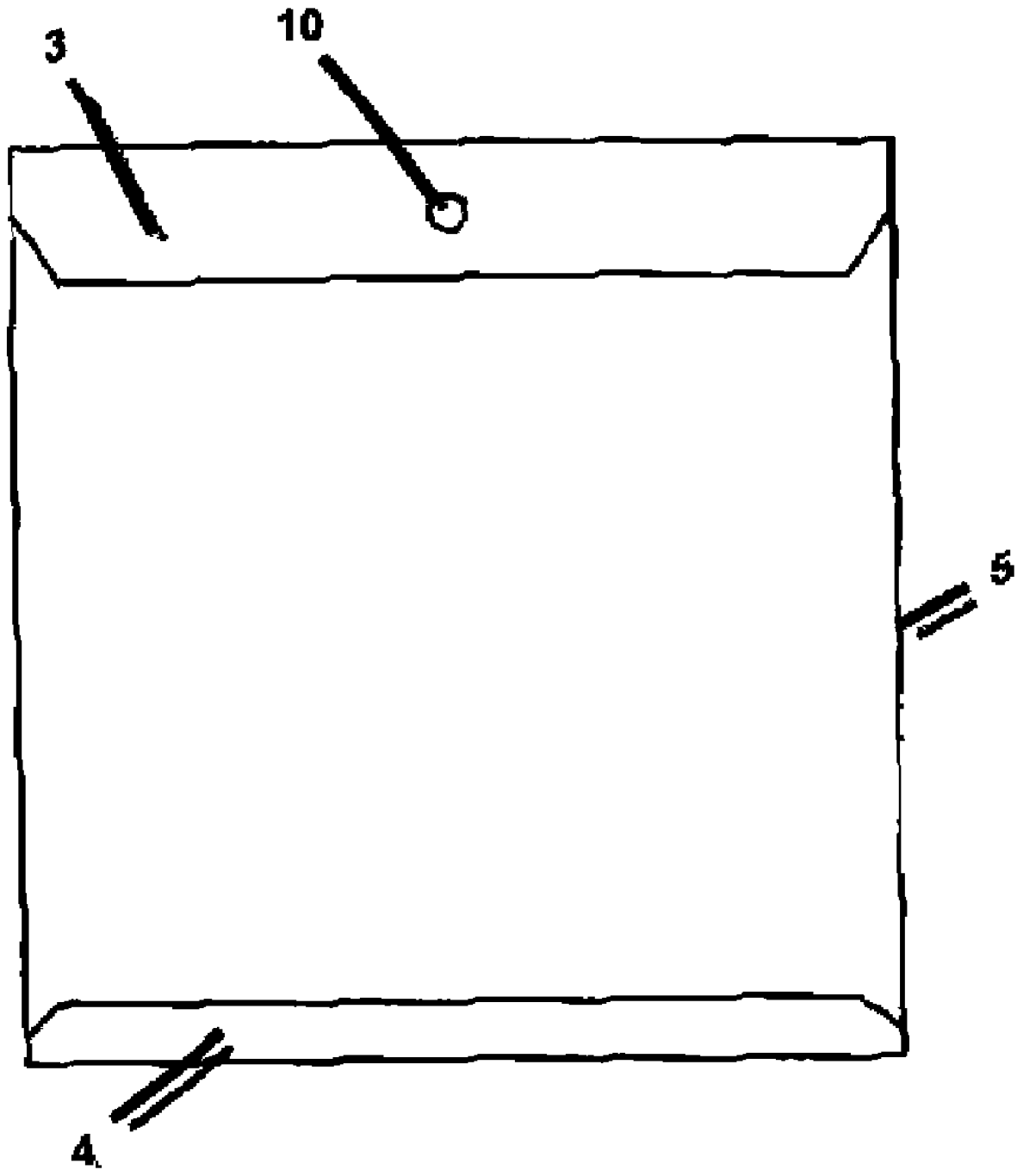
FIG. 5 is a plan view of the envelope with folded top and bottom folds.
Figure 6:
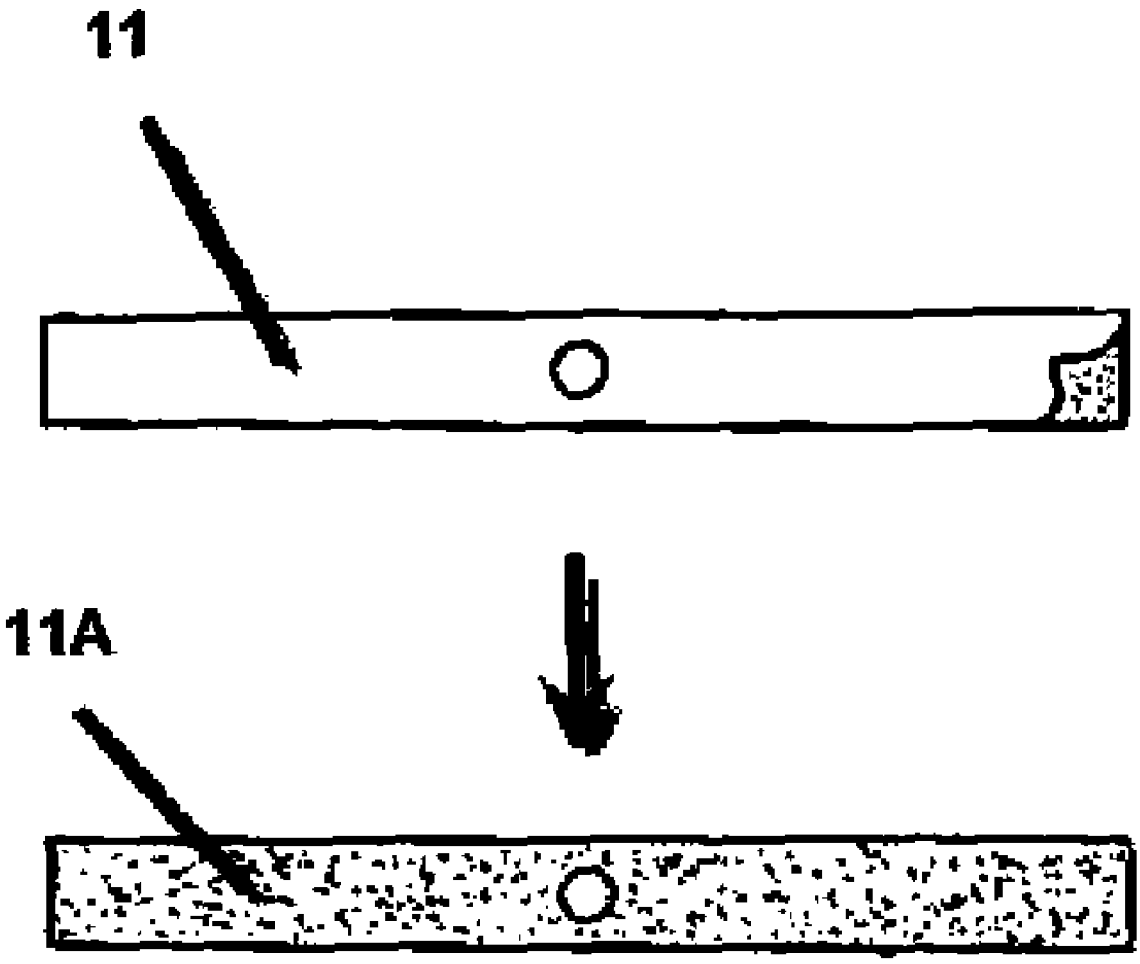
FIG. 6 illustrates an adhesive strip with a peel back paper on both sides being partially separated and completely separated.

The top seam of the envelope is formed by securing fold 3 to the front wall via a peel back paper 11 and another strip 12 formed the same as detailed above with respect to the bottom seam. As shown in FIG. 6, the peel back paper 11 includes adhesive on both sides and cover strips on both sides. During use, the cover strip on one side is removed and the adhesive is used to secure the peel back paper to the fold 3. When it is desired to seal the top of the envelope, the cover on the other side of the peel back paper 11 is removed and secured to the strip 12 at the top of the envelope. The peel back paper 11 is shown with a cover partially removed at 11 in FIG. 6 and with both covers removed at 11A in FIG. 6.

Figure 14:
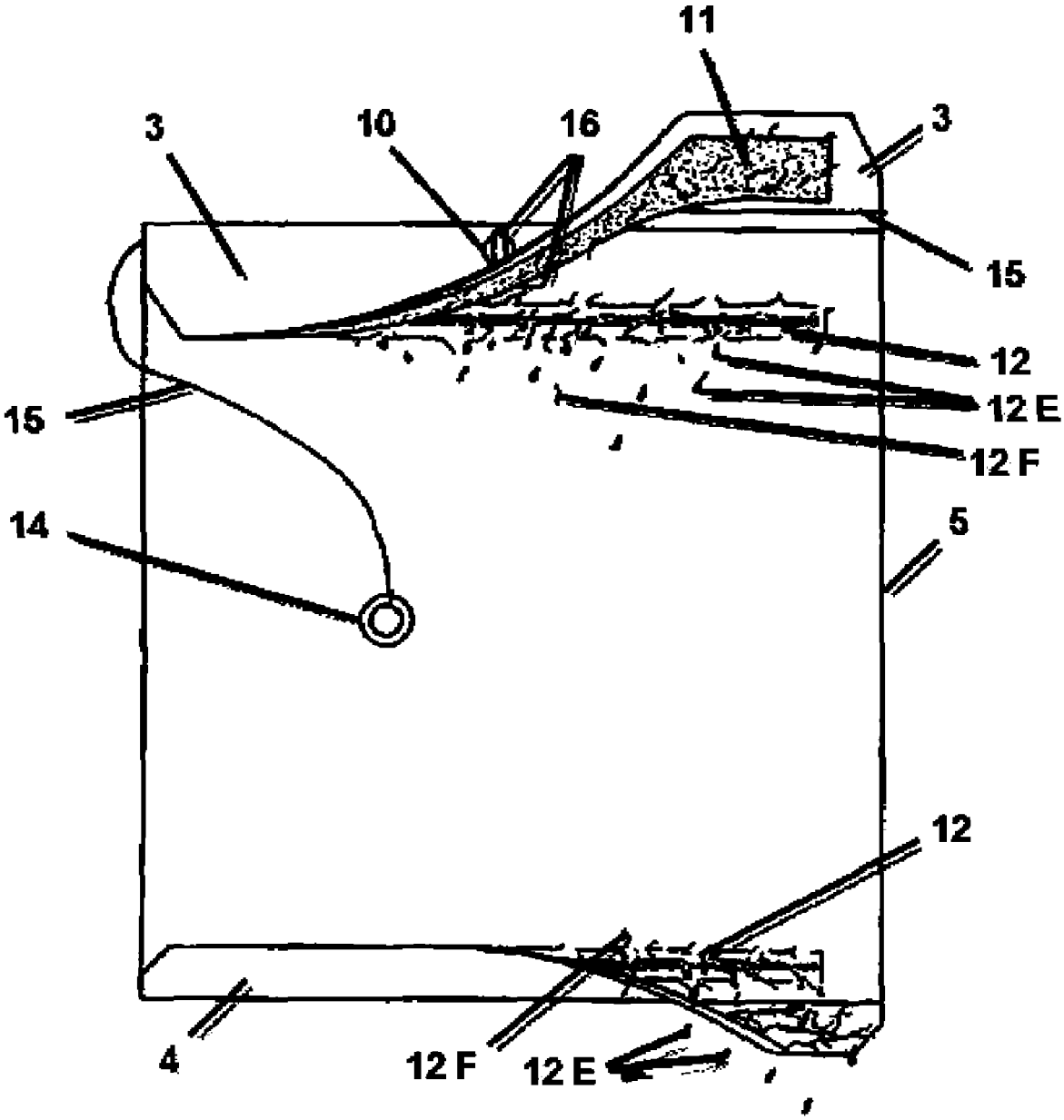
FIG. 14 illustrates unauthorized opening of the top and bottom seams with release of the dye to indicate tampering.

As best depicted in FIG. 14, any attempt to separate the top or bottom seam of the envelope after closing will result in tearing of the first and second clear strips 12A, 12B as shown by 12F allowing drops of the dye 12E to escape from the groove onto the adjacent portions of the envelope and thereby provide visual evidence that the envelope has been opened.

Figure 15:
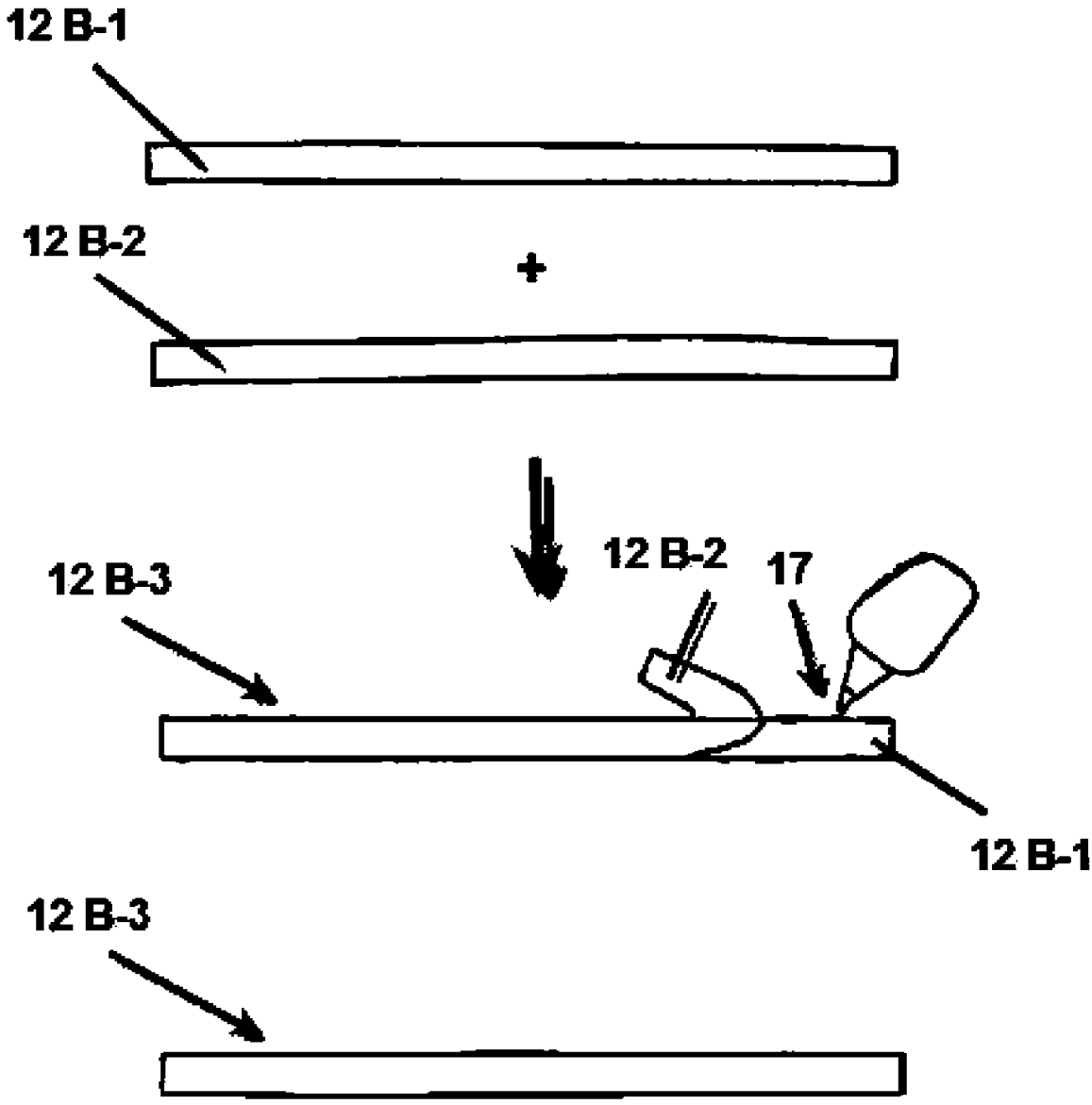
FIG. 15 illustrates a second embodiment of the clear plastic strip formed from two bonded strips.
Figure 16:
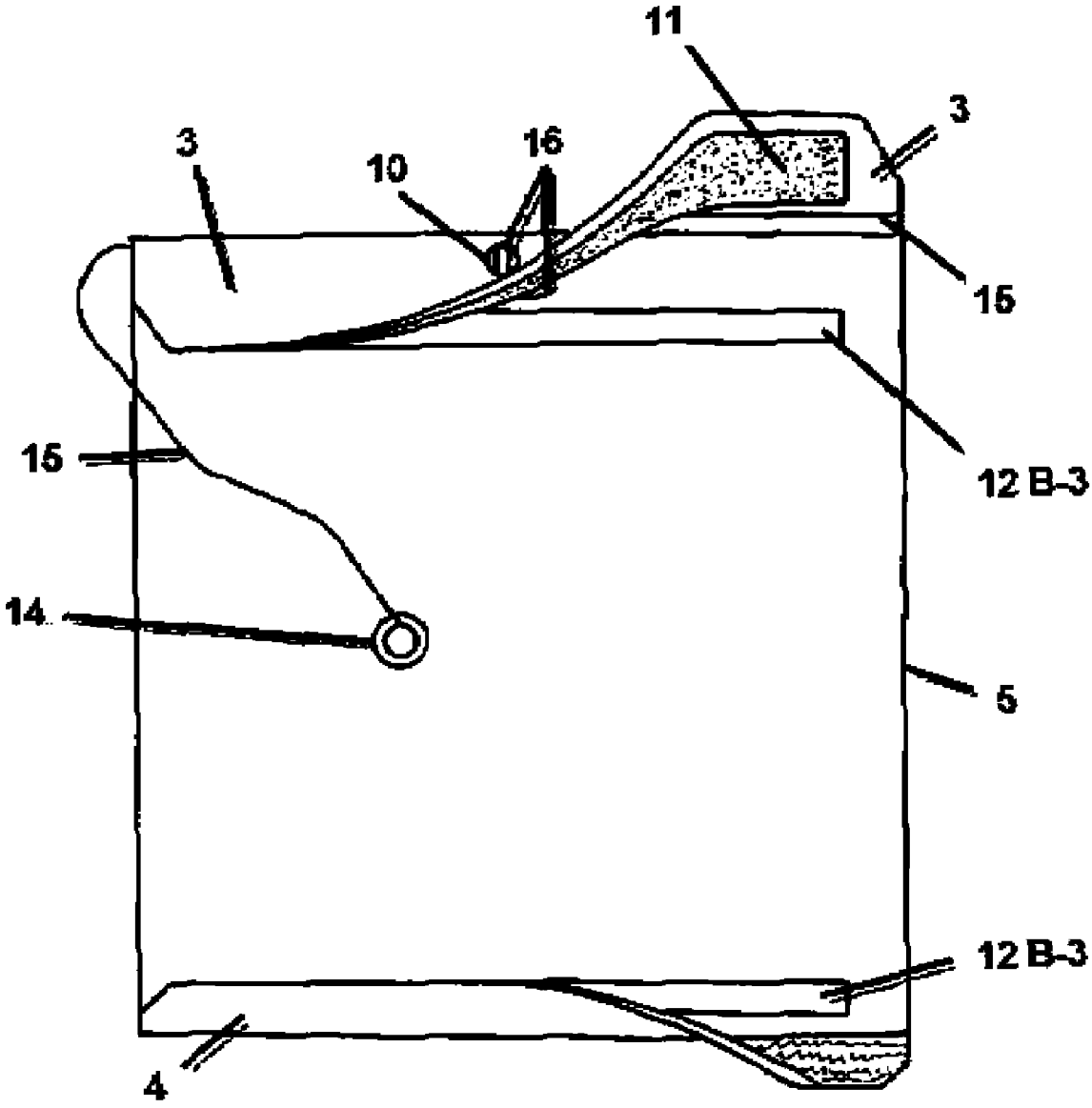
FIG. 16 shows the envelope in a partially folded position and incorporating the second embodiment of the clear plastic strip.
Figure 17:
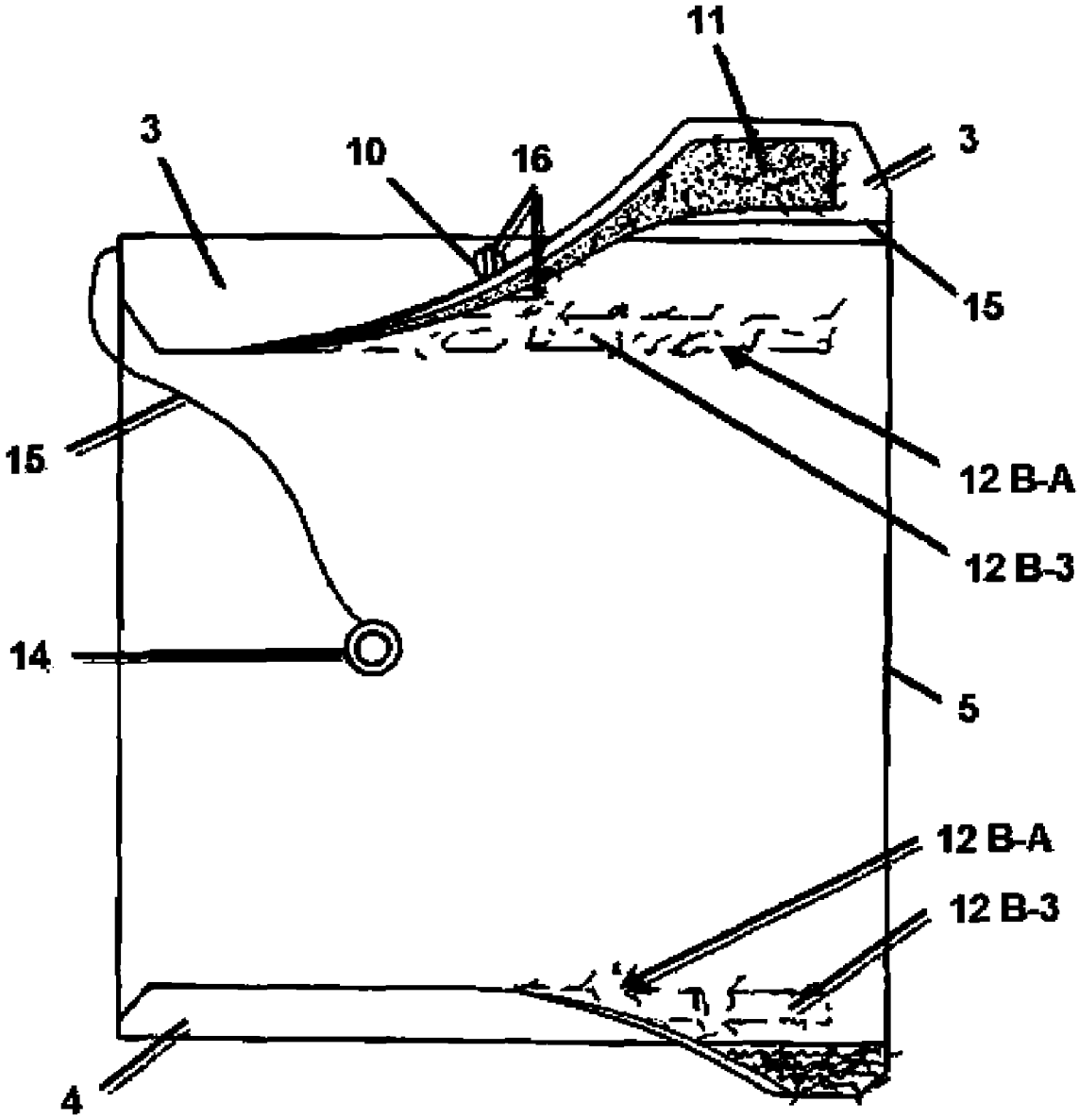
FIG. 17 illustrates opening of the top and bottom seams of the second embodiment with destruction of the clear plastic strip to indicate tampering.
Figure 18:
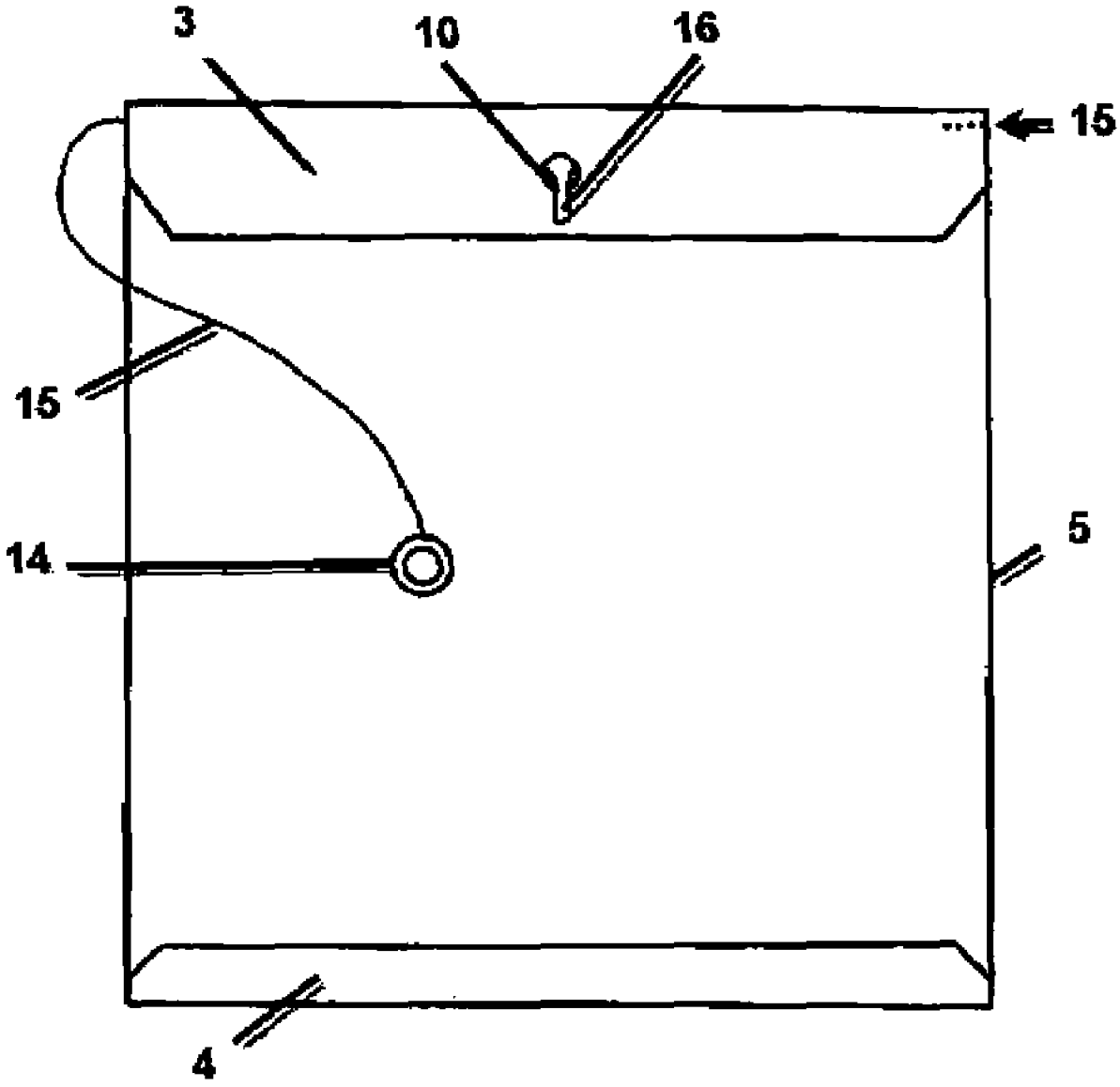
FIG. 18 is a plan view of the front of the envelope in a closed position.

A second embodiment of the strip 12B-3 is shown in FIGS. 15-17 and comprises a glued strip front 12B-1 bonded to a glued strip back 12B-2 each of clear thin light plastic. In this embodiment, separation of the seam results in destruction of the clear plastic strip 12B-3 as shown at 12B-A in FIG. 17 which provides evidence of tampering.

Figure 9:
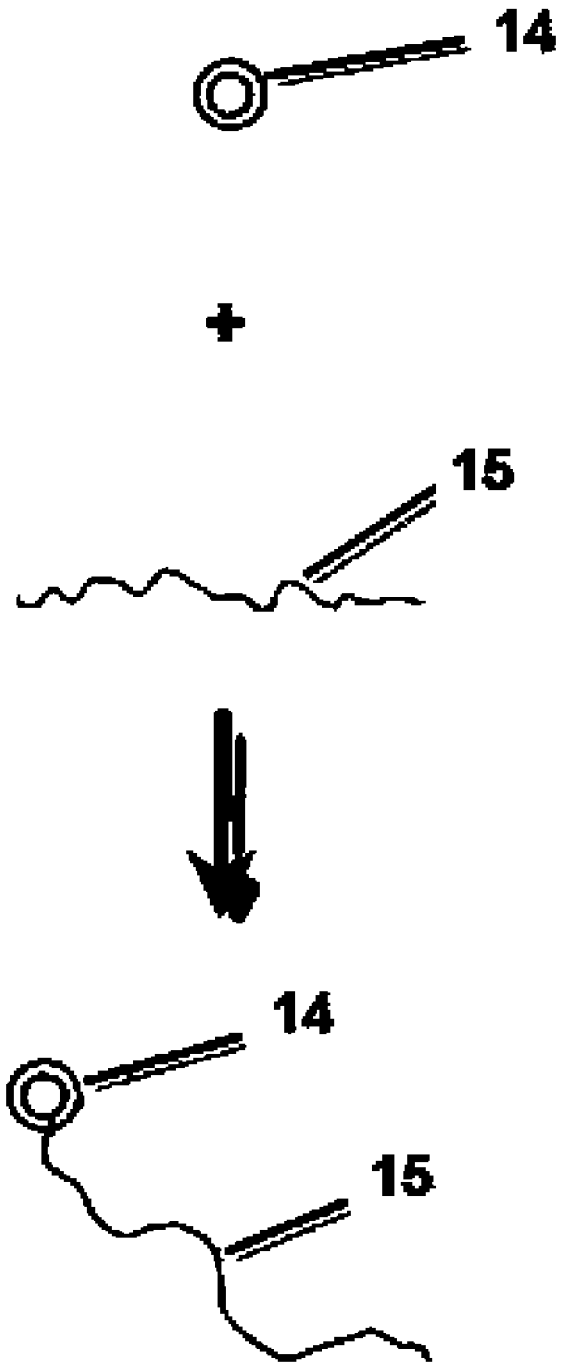
FIG. 9 shows a loop and a string which together form a pull string for the envelope.
Figure 10:
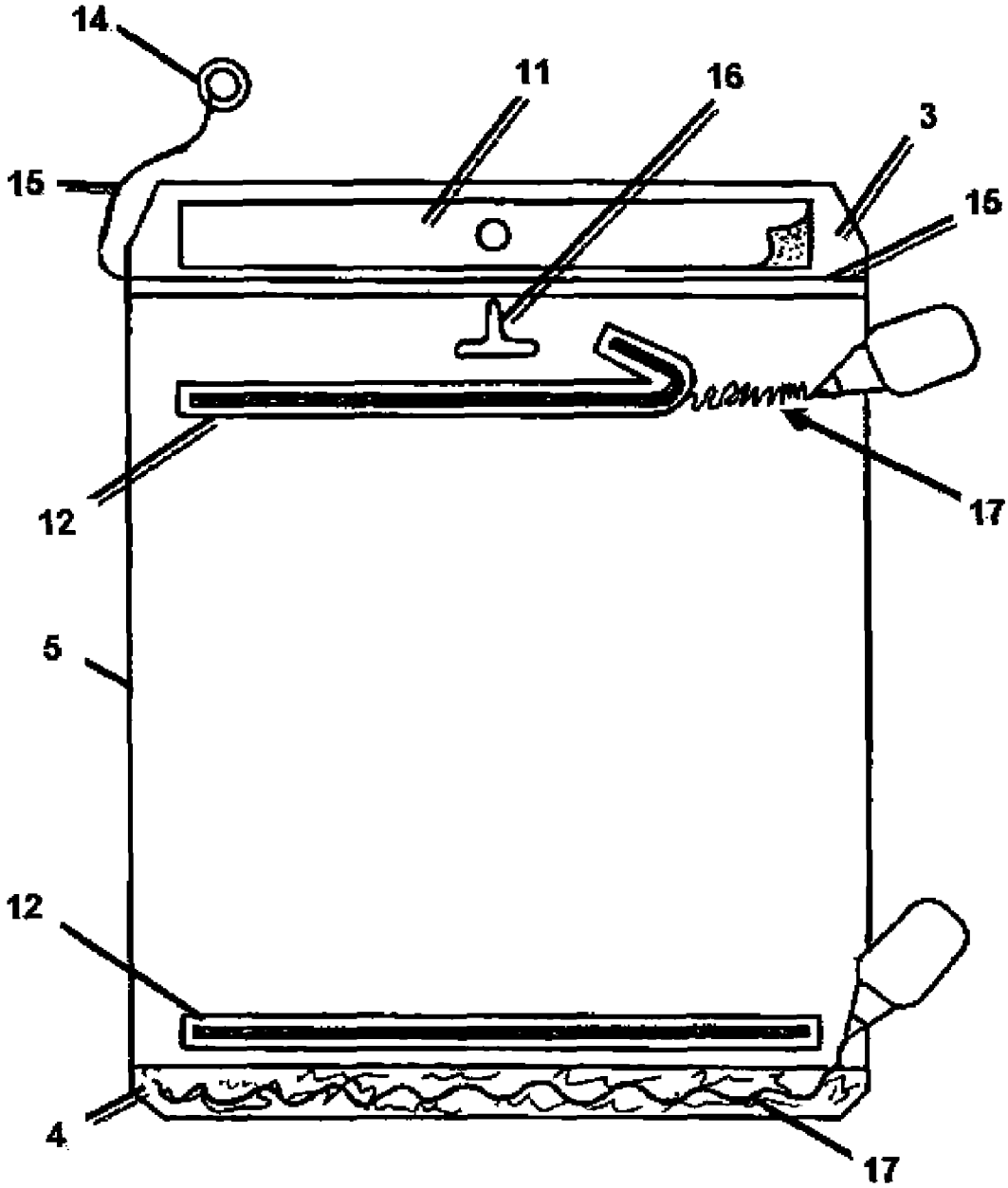
FIG. 10 is a plan view of the permanent seal legal envelope in an open position prior to initial sealing of the envelope and incorporating the various sealing, securing and opening elements of the envelope.
Figure 11:
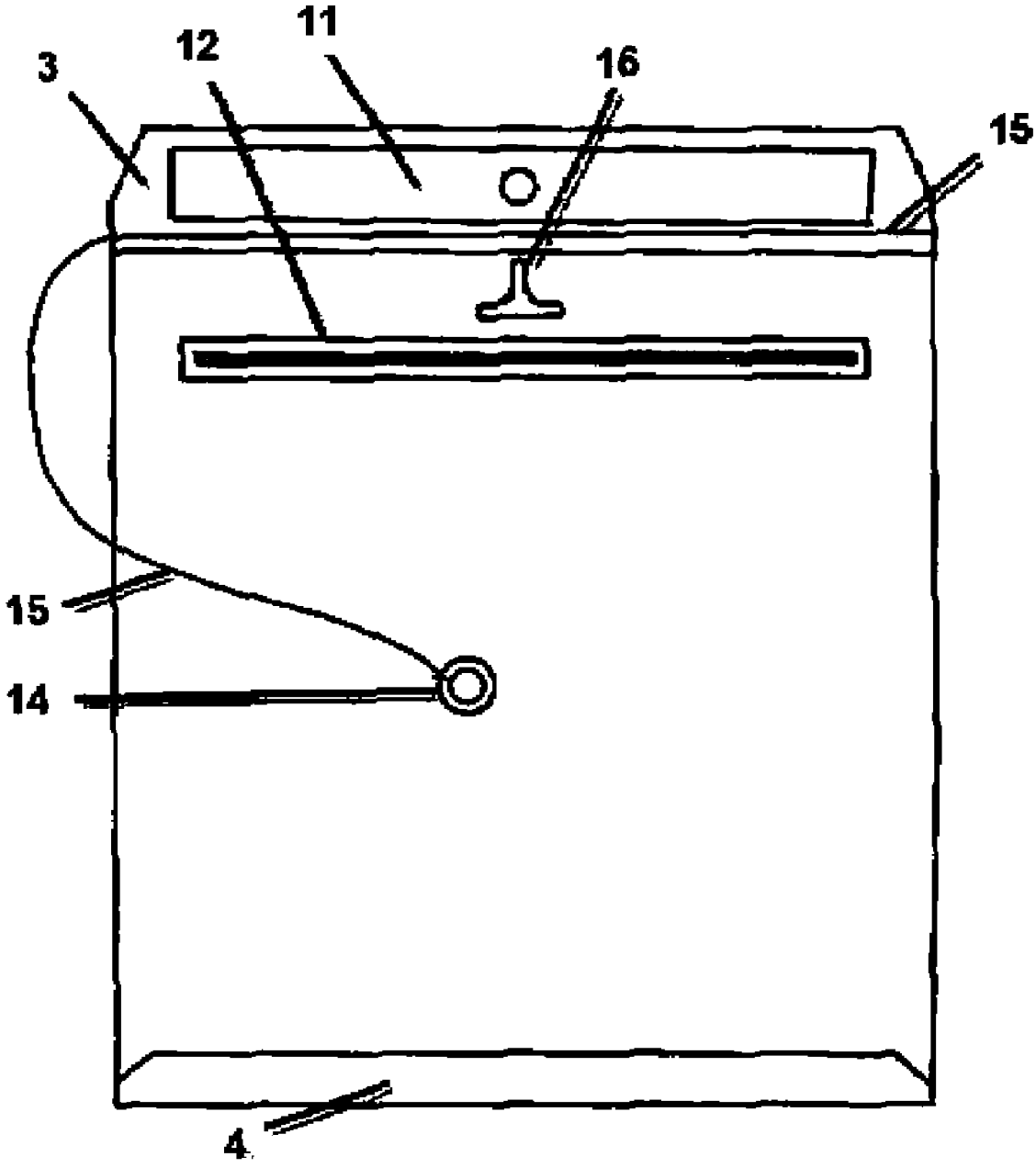
FIG. 11 is a plan view of the permanent seal legal envelope with the bottom fold secured and prior to securing the top fold.
Figure 13:
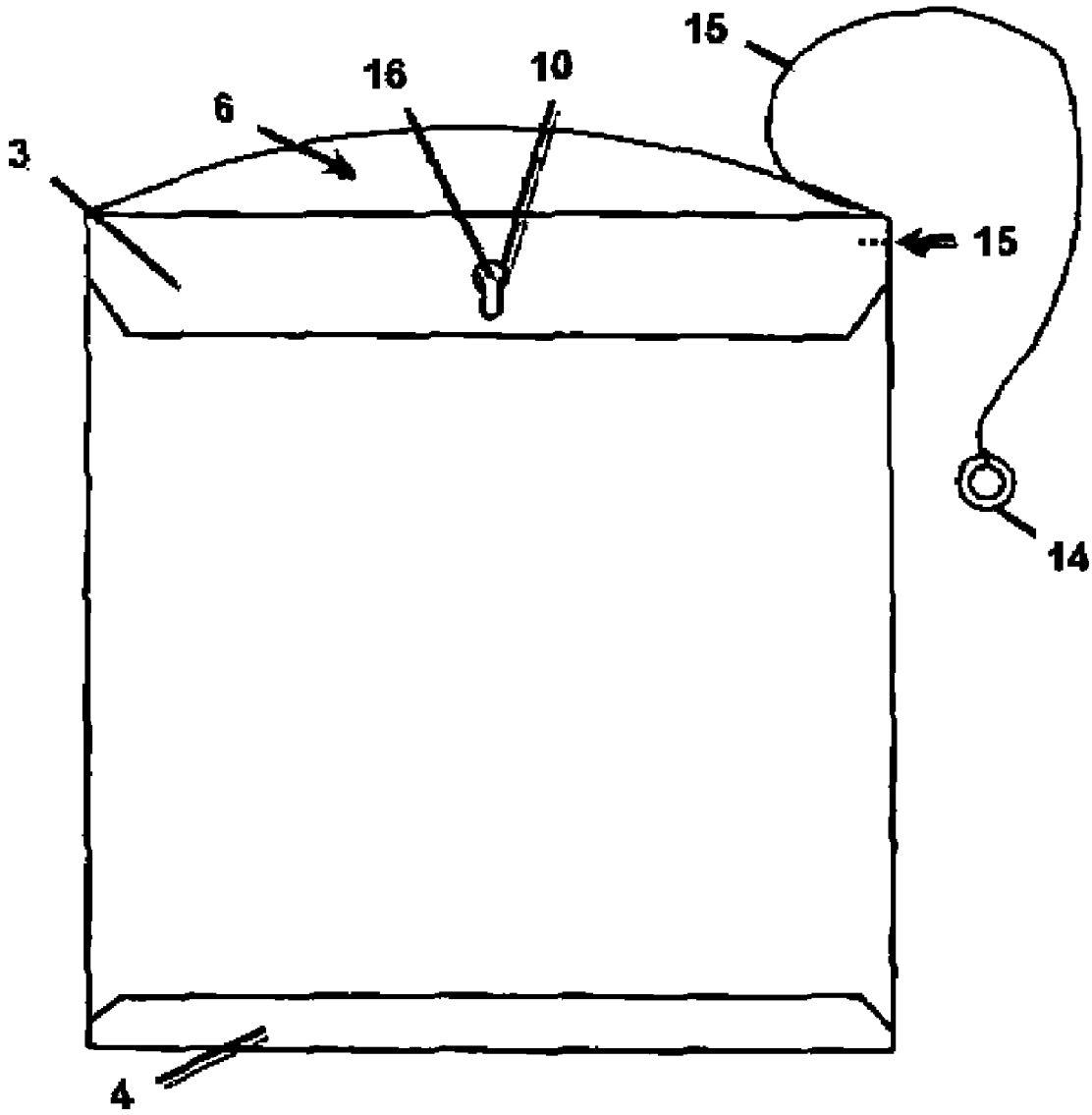
FIG. 13 illustrates opening the top of the envelope using the loop and string.

As shown in FIG. 9, a nylon string 15 and a plastic loop 14 are secured to form an opening mechanism in the envelope. The string is bonded to the fold 3 as depicted in FIGS. 1, 10-14 and 16-18 and is positioned inside the fold when the envelope is closed. FIG. 13 illustrates opening of the container by pulling the string along the top to separate the portion or rim 6 at the top of the envelope. The envelope also includes a clasp 16 secured to the top of the front wall which extends through an aperture 10 formed in the fold 3 and the peel back paper 11.

While various embodiments of this invention have been illustrated and described as noted above, many changes can be made without departing form the spirit and scope of the invention. For example, the envelope can be made out of different kinds of material such as paper and plastic or can be made in different colors and/or with different sizes and shapes. The envelope can be made seamless all the way around the middle. The clear plastic strips can be made in different colors of plastic and in different sizes and shapes. The nylon string can come in different colors and different sizes. The plastic loop can be made with different colors and sizes. With respect to the first embodiment, different kinds of dye could be used such that when the dye touches the paper, it changes to different colors. The clasp may be formed from aluminum having various colors and the clasp may be of various sizes. Other aspects of the invention will be apparent to those skilled in the art from consideration of this disclosure. It is intended that the specification and examples above be considered as exemplary only.

The invention claimed is:

1. A tamper evident envelope comprising:

a main portion formed by front and back walls, a top portion and a bottom portion, each of said top and bottom portions including a fold extension for closing the respective top and bottom portion, said top and bottom portions each including a strip formed by first and second strip portions secured to each other, said first strip portion including a groove along the length of the strip extending from adjacent one end of the strip to adjacent an opposing end of the strip, said strips being secured between said top and bottom portion fold extensions, respectively and said front wall to form seams at the top and bottom portions of the envelope, a dye sealed within each said groove between said first strip portion and said second strip portion of each strip, means for opening said envelope to access the interior of the envelope, whereby separation of one of said seams damages the respective strip allowing said dye to escape from said strip onto adjacent portions of the envelope to form a visual indicator that the one seam has been opened.

2. A tamper evident envelope as set forth in claim 1, wherein said top portion further includes a peel back paper, said peel back paper including adhesive on two opposing sides of said peel back paper, said adhesive securing said peel back paper to said top portion fold extension and to said top portion strip.

3. A tamper evident envelope as set forth in claim 2, wherein said peel back paper includes a cover overlying said adhesive on one side, said cover being removed to allow securement of the peel back paper to the strip at the top portion of the envelope.

4. A tamper evident envelope as set forth in claim 1, wherein said means for opening said envelope includes a string secured to the top portion fold extension and a loop attached to the string at one end.

5. A tamper evident envelope as set forth in claim 1, wherein said top portion fold extension including an opening and said front wall including a clasp secured thereto for receipt within the opening.

6. A tamper evident envelope as set forth in claim 1, wherein said first and second strip portions being formed from a clear plastic material.

* * * * *